US006118066A

United States Patent [19]

Sirmalis et al.

[11] Patent Number: 6,118,066

[45] Date of Patent: Sep. 12, 2000

[54] AUTONOMOUS UNDERSEA PLATFORM

[75] Inventors: John E. Sirmalis, Barrington; Pamela J. Lisiewicz, Tiverton, both of R.I.

[73] Assignee: The United States of America as represented by the Secretary of the Navy, Washington, D.C.

[21] Appl. No.: 08/936,786

[22] Filed: Sep. 25, 1997

[51] Int. Cl.[7] ..... F42B 19/10

[52] U.S. Cl. ..... 114/20.1

[58] Field of Search ..... 367/133; 114/312, 114/313, 322, 316, 20.1, 20.2, 21.1, 21.2, 21.3, 337; 102/399, 390; 89/5; 42/1.14; 343/709, 710

[56] References Cited

U.S. PATENT DOCUMENTS

| | | | |
|---|---|---|---|
| 491,051 | 1/1893 | Holland | 89/5 |
| 841,961 | 1/1907 | Gray | 114/325 |
| 1,345,551 | 7/1920 | Rieschick | 89/5 |
| 1,747,886 | 2/1930 | Bechard | 114/325 |
| 1,840,094 | 1/1932 | Hatch | 114/322 |
| 2,272,952 | 2/1942 | Reed, Jr. | 114/325 |
| 2,332,549 | 10/1943 | Bear | 114/322 |
| 3,161,168 | 12/1964 | Rebikoff | 114/21.1 |
| 3,302,602 | 2/1967 | Korganoff | 114/337 |
| 3,492,965 | 2/1970 | Wayfield | 114/337 |
| 3,503,356 | 3/1970 | Wilson | 114/337 |
| 3,506,967 | 4/1970 | Foley | 114/21.1 |
| 3,943,869 | 3/1976 | Frechette | 114/337 |
| 4,227,479 | 10/1980 | Gertler et al. | 114/312 |
| 4,448,145 | 5/1984 | Hervieu | 114/312 |
| 4,947,782 | 8/1990 | Takahashi | 114/312 |
| 5,012,717 | 5/1991 | Metersky et al. | 114/21.1 |
| 5,097,780 | 3/1992 | Winchester | 114/330 |
| 5,301,166 | 4/1994 | Charlton | 114/21.2 |
| 5,434,584 | 7/1995 | Kelly | 343/710 |
| 5,438,947 | 8/1995 | Tam | 114/312 |
| 5,574,246 | 11/1996 | Meyers et al. | 114/337 |
| 5,675,116 | 10/1997 | Hillenbrand | 114/21.2 |
| 5,734,121 | 3/1998 | Balzarini | 114/21.3 |
| 5,844,159 | 12/1998 | Posseme et al. | 114/21.1 |
| 5,880,694 | 3/1999 | Wang et al. | 343/700 MS |

*Primary Examiner*—Charles T. Jordan
*Assistant Examiner*—Denise J Buckley
*Attorney, Agent, or Firm*—Michael J. McGowan; Robert W. Gauthier; Prithvi C. Lall

[57] ABSTRACT

The invention provides an unmanned, autonomous, undersea platform which extends the sphere of influence of a host vessel from which it is launched. The platform is hydrodynamically and stealth shaped to minimize noise, wake and detectability of the platform. The platform includes advanced active and passive sensors for monitoring the undersea environment, high data rate RF and satellite communications capabilities for communication with the host vessel when necessary, forward deployed offensive and defensive weapons systems and sophisticated data processing to coordinate the sensing, communications and weapons systems with minimal direction from the host vessel. Prior to launch, mission directives are input to the data processors. Using artificial intelligence and neural network programming for decision making, the processors constantly update the platform's operating parameters to conform with changing environmental and threat conditions and to successfully complete the mission.

19 Claims, 3 Drawing Sheets

AUTONOMOUS UNDERSEA PLATFORM

STATEMENT OF GOVERNMENT INTEREST

The invention described herein may be manufactured and used by or for the Government of the United States of America for governmental purposes without the payment of any royalties thereon or therefore.

BACKGROUND OF THE INVENTION (1) Field of the Invention

The present invention relates generally to undersea vehicles, and more particularly to an autonomous, unmanned undersea vehicle providing a platform for an expanded theater of operations for a submarine or surface ship.

(2) Description of the Prior Art

Increasing budgetary constraints and the shrinking number o submarines will continue to stretch the asset base for submarine operations. It is necessary that each new planned submarine platform be capable of operating in a wide variety of hostile environments. The advancing technology of hostile forces also provides for a far more quiet and capable threat to undersea operations and decreases threat recognition and reaction times. The risk of more regionalized threats increases the need for shallow water, or littoral, operations. The shallow water and land/sea interface increase sonar noise and reverberation levels, making the littoral environment a cluttered one for underwater operations. In addition, the coastal environment is a high traffic area which may include both friendly and neutral players as well as hostile forces. The intrusion of a large submarine platform into these waters not only creates threats to ongoing friendly and neutral traffic and shipping interests, but, due to its large draft, may also incur a greater risk of detection for the submarine platform as well as increased risk to platform personnel. Further, the draft of the submarine platform may be too great for operation in many littoral areas of interest. The use of unmanned undersea vehicles (UUV's) provides a unique means for a submarine to extend its reach and sphere of influence in this type of environment. Current UUV's, however, lack the capabilities needed for successful multi-mission operation as a forward deployed submarine adjunct. Used mainly in exploratory research, or single mission operations, these vehicles lack the autonomous operation, on board processing, communications and offensive and defensive weapons capabilities needed to realistically extend the tactical sphere of influence. For example, U.S. Pat. No. 4,448,145 to Hervieu discloses an unmanned submarine vehicle for bottom dredging, nodule collection, pelagic fishing, or raising of submerged bodies. For each mission, the routing of the Hervieu vehicle must be preprogrammed into the vehicle or directly controlled from a mother ship. Such preprogramming or direct control limits the use of the Hervieu vehicle to controlled, or well known environments and would make the Hervieu vehicle ineffective in a littoral arena where conditions may be constantly changing. Current submarine launched torpedoes are another well known example of single mission, unmanned, underwater vehicles. While torpedoes may incorporate sophisticated guidance technology with which to track changing targets, there use is limited to the single mission for which the guidance technology is programmed. Other possible platforms for extending a tactical sphere of influence include remotely operated vehicles (ROV's). However, ROV's require constant tether with the mother ship which may limit the range of operation and may not be possible during a hostile engagement.

SUMMARY OF THE INVENTION

Accordingly, it is an object of the present invention to provide an unmanned, undersea platform to extend the sphere of influence of a submarine.

Another object of the present invention is to provide an unmanned, undersea platform which can operate in a wide variety of environments, including operation in shallow water, or littoral environments.

Still another object of the present invention is to provide an unmanned, undersea platform capable of autonomous operation.

A still further object of the present invention is to provide an unmanned, undersea platform capable of multiple missions.

Yet another object of the present invention is to provide an unmanned, undersea platform having on board processing, communications and offensive and defensive weapons capabilities.

Other objects and advantages of the present invention will become more obvious hereinafter in the specification and drawings.

In accordance with the present invention, an unmanned, autonomous, undersea platform is provided having the capabilities needed to extend the submarine's sphere of influence in deep water and to make littoral operations practical. The platform is launched from the submarine mother ship and includes advanced active and passive sensors for monitoring the littoral or undersea environment, high data rate RF communications capabilities for communication with the mother ship when necessary, forward deployed offensive and defensive weapons systems and sophisticated data processing to coordinate the sensing, communications and weapons systems with minimal direction from the mother ship. These capabilities allow the platform to conduct surveillance, uncover and map minefields and track, or destroy, hostile vessels. The platform utilizes the latest state of the art power system for high power and long life. The propulsion unit consists of thrusters or ducted propellers, both forward and reverse, within the hydrodynamically shaped vehicle to minimize both noise and wake. Sensors include acoustic and non-acoustic sensors such as active and passive sonar, wake detection sensors and chemical sensors, with the "skin" of the platform consisting of a conformal array. Navigational aids include Doppler aided inertial waypoint navigation, bounded by global positioning system (GPS) fixes. The communications systems include the use of an extendible planar phased array antenna mounted on a retractable mast section for high data rate, secure (low probability of intercept) satellite, RF and video communications, as well as acoustic communications. The acoustic communications provide robust long range communications at medium data rates and robust short range communications at high data rates. The weapons payload includes high speed, covert launch ("swim out") weapons, "smart" countermeasures and close-in defensive weapons.

The autonomous platform is designed to be an adjunct to a submarine or other host vessel. When required, the internal data processors are directed to perform a mission, e.g., sweep an area for minefields, and the platform is launched from the host vessel. Based on the mission and observed data, the internal data processor, acting through artificial intelligence programming, directs the autonomous platform in the independent completion of its mission and communicates whenever necessary with the host vessel, providing the host vessel with the latest data to be integrated into the subsurface, surface and satellite total tactical picture. Status updates, mission changes, or weapons launch decisions can be directed from the mother ship, but the platform has decision making capabilities such that communication with the host vessel is not required for successful operation of the platform.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein corresponding reference characters indicate corresponding parts throughout the several views of the drawings and wherein.

DESCRIPTION OF THE PREFERRED EMBODIMENT

Figure 1:
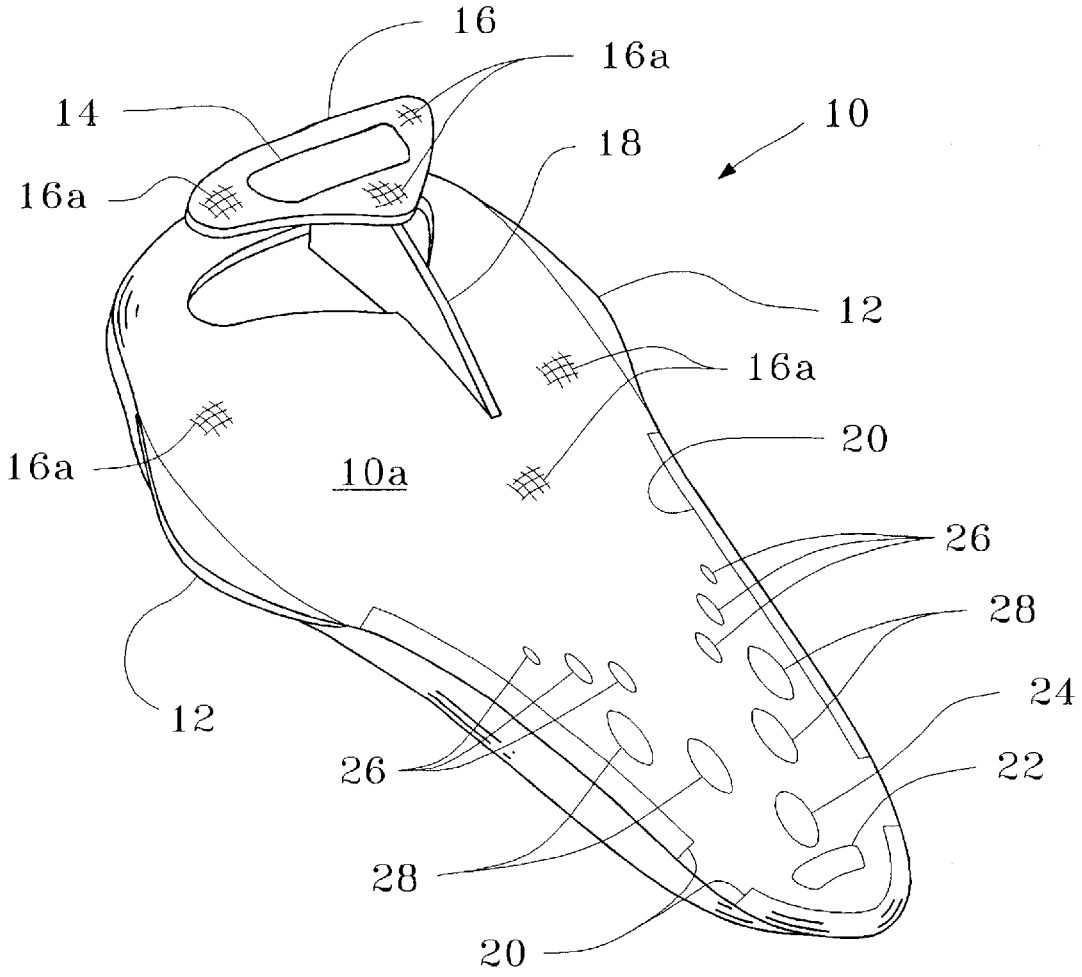
FIG. 1 is a schematic representation of the autonomous undersea platform of the present invention as seen from above.

Referring now to FIG. 1, there is shown a schematic representation of unmanned, autonomous, undersea platform 10. Platform 10 is hydrodynamically shaped for efficient underwater operation and to minimize noise and wake, thus minimizing detection. Stealth shaping is incorporated into the hydrodynamic shape to further minimize detection of platform 10. The hydrodynamic and stealth shaping is achieved through the use of composite materials for the outer hull 10*a* of platform 10. Control vanes 12 are integrated into the platform shape to increase maneuverability. A number of antennas and sensors provide platform 10 with communications and sensing capabilities, including planar phased array 14 which provides platform 10 with satellite communications. Phased array 14 is part of antenna suite 16 which is mounted on extendible mast 18. When satellite communications are necessary, platform 10 approaches the water surface (not shown) and extends mast 18, in the manner shown in FIG. 1, such that antenna suite 16 and array 14 are above the water surface. Mast 18 and antenna suite 16 also serve as vertical and horizontal stabilizers, respectively, for additional maneuvering capabilities. Antenna suite 16, as well as the outer hull 10*a*, may include structurally embedded electronic warfare antennas 16*a* for additional communications capabilities. Conformal arrays 20, arranged along edges of platform 10, provide active and passive acoustic sensing. Other sensors, such as sonar, ocean environment, optical, chemical and wake detection sensors, designated by area 22, provide further communications and sensing capabilities. While the sensors are indicated as grouped in area 22, sensors will be located on platform 10 as necessary to maximize their operation. Since it is anticipated that platform 10 will be entering hostile environments, short range defensive weapon 24 is provided in the bow of platform 10 for in-close defensive capabilities. Short range defensive weapon 24 is shown configured as an underwater gun 24, but other short range projectile launchers may be used. Additional longer range defensive weapons and countermeasures, such as decoys and buoy launchers, designated by areas 26, are also provided. Offensive weapons, designated by areas 28, include well known high speed, stealth and covert launch torpedoes.

Figure 2:
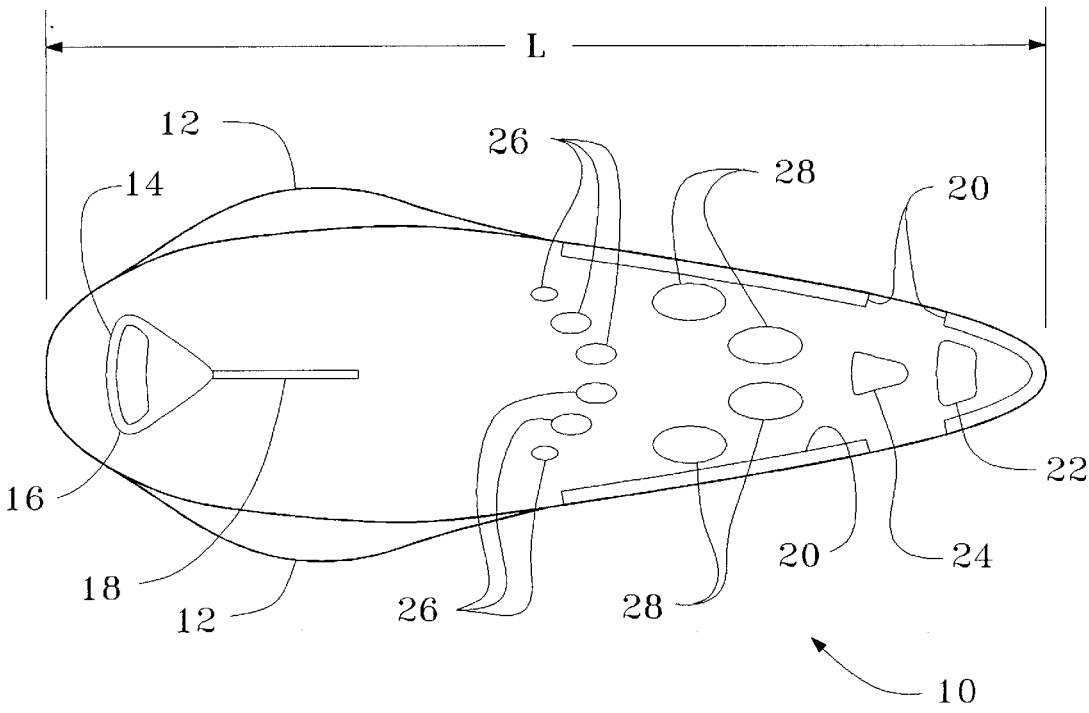
FIG. 2 is a top view of the autonomous undersea platform of the present invention.
Figure 3:
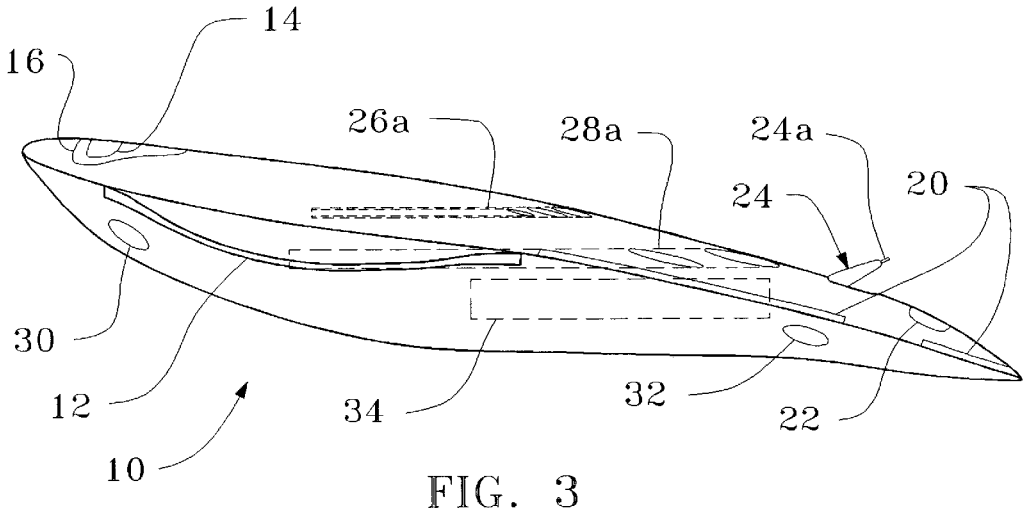
FIG. 3 is a side view of the autonomous undersea platform of the present invention and FIGS. 4A, 4B show the platform being launched from a surface vessel and an airborne vessel, respectively.

Referring now to FIGS. 2 and 3, there are shown top and side views, respectively, of platform 10, better illustrating the hydrodynamic and stealth shape of platform 10 and the relationship of the various subsystems identified in FIG. 1. In FIGS. 2 and 3, mast 18 is retracted such that antenna suite 16 and array 14 are flush with the surface of platform 10. Conformal arrays 20 surround the forward edges of platform 10 and sensor area 22 is shown placed forward for obtaining navigational data. As noted for FIG. 1, sensors may be located on platform 10 wherever necessary for efficient operation. In FIGS. 1 and 2, short range defensive weapon 24 is shown flush with the surface of platform 10. In FIG. 3, however, short range defensive weapon 24 is shown as an underwater gun, deployed by rotating its muzzle end 24*a* up from platform 10. FIG. 3 further shows the stacked arrangement of long range defensive weapons and countermeasures 26 and offensive weapons 28, indicated by dashed line 26*a* and 28*a*, respectively. In order to provide quiet operation and minimize detection, platform 10 utilizes thruster or ducted propeller propulsion in lieu of external propellers. State of the art, compact, high power batteries (not shown) are used to power platform 10. The locations of forward and reverse thruster outlet ports 30 and 32 are indicated in FIG. 3.

In operation, platform 10 serves as an adjunct to a submarine to extend the submarine's sphere of influence. Since the overall size of platform 10 is substantially smaller than that of the submarine, having an overall length "L" of between 60 feet to 90 feet, the platform can enter into arenas not well suited for the large size and draft of a submarine, such as littoral arenas. In addition, the submarine may launch multiple platforms each performing separate missions, thus increasing a single submarine's effectiveness. To perform a mission, mission directives are loaded into internal data processors (shown in FIG. 3 as dashed lines 34) within each platform 10. Platform 10 is then quiet launched, or allowed to "swim-out" from the submarine. Examples of mission directives include ocean bottom mapping, minefield search and mapping, target search and acquisition, intelligence gathering, surveillance and general reconnaissance. Using artificial intelligence or neural network programming, data processors 34 include decision making capabilities to constantly update platform 10 operations to conform with changing data inputs from arrays 20, sensors 22 and antenna suite 16. Gathering appropriate data, the internal data processors also perform Doppler aided inertial waypoint navigation bounded by GPS fixes. Appropriate thruster ports 30 and 32 are activated to propel platform 10 in the desired direction. If needed, defensive weapons and countermeasures 24 and 26 can be deployed when the mission of platform 10 is compromised by a hostile force. When a threat has been positively identified, offensive weapons 28 can be deployed. Gathered data is also communicated acoustically or through satellite communications back to the submarine and platform 10 may receive updated mission directives from the submarine during operations. Upon mission completion, platform 10 returns to the submarine.

The invention thus described provides a hydrodynamically and stealth shaped, unmanned, autonomous undersea platform providing an extended sphere of influence for a submarine, including increased capabilities in a littoral environment. The small size of the autonomous platform in comparison to the submarine allows for its operation in such environments with a greatly decreased threat of discovery and with a greatly decreased threat to friendly or neutral operations. The autonomous undersea platform can provide detailed intelligence, surveillance and environmental data to the submarine without the need for the submarine to enter the littoral area. The autonomous platform permits the submarine to remain in deeper water where it will be relatively less detectable. Advanced weapons systems make the platform an excellent stand-off weapon system, drawing fire to an unmanned vehicle as opposed to the manned submarine. The artificial intelligence and neural network processing capabilities allow the platform to operate autonomously when provided with general mission requirements and boundaries.

Figure 4A:
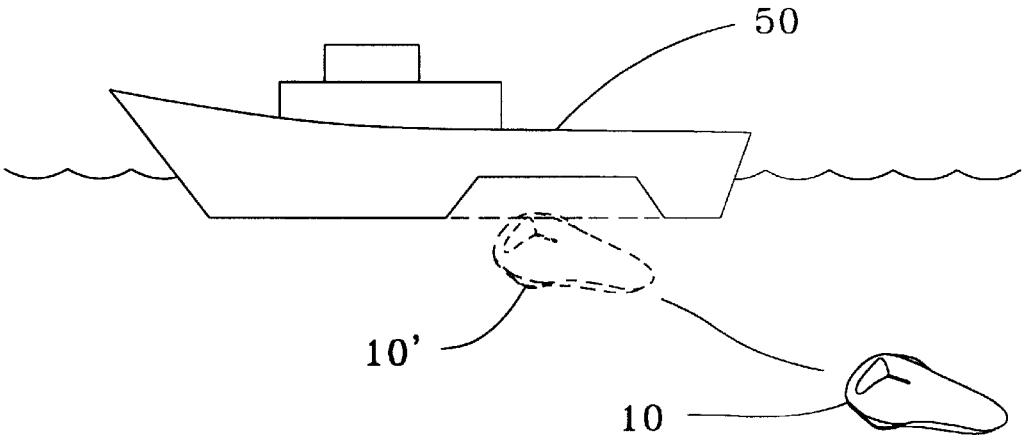
Figure 4B:
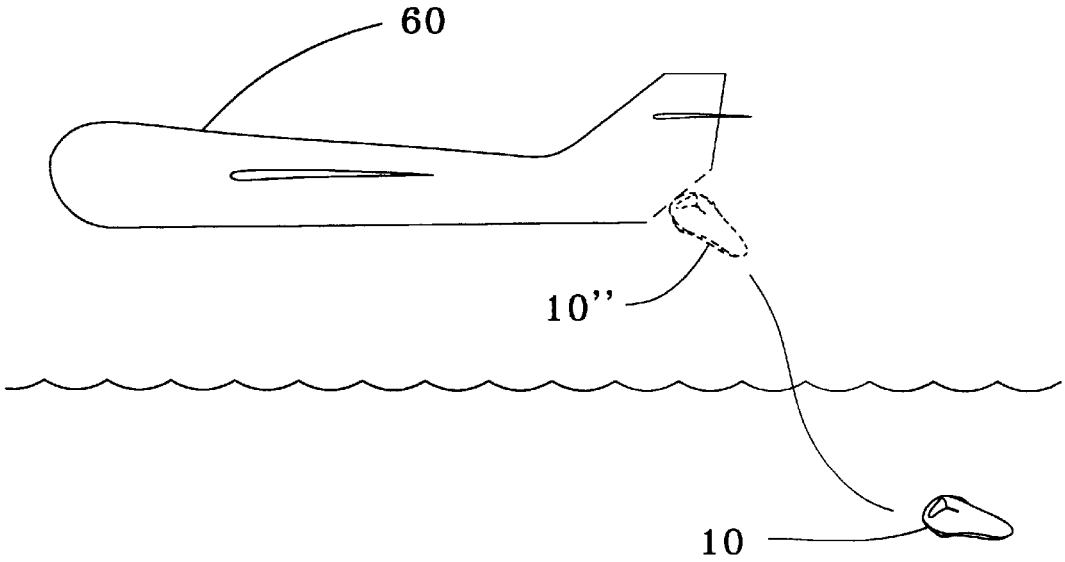

Although the present invention has been described relative to a specific embodiment thereof, it is not so limited. For example, the platform 10 may be used as an adjunct to a surface vessel 50, as shown in FIG. 4A, with 10'indicating platform 10 being launched from vessel 50. When a submarine or surface vessel is not readily available in an area, the platform 10 may be air dropped from an airborne vessel 60, as shown in FIG. 4B, with 10"indicating platform 10 being launched from vessel 50, providing a credible undersea presence within a short time frame. In the case of a surface vessel or airborne launched platform, the shape of the platform will be configured to conform with the host vessel. In either case, the autonomous platform will extend the vessel's sphere of influence into the underwater arena. Additionally, the various communications, sensor and weapons systems can be reconfigured to be the most efficient for the planned mission. For example, where the mission is strictly reconnoitering, offensive weapons capabilities can be replaced with deployable sensor units.

Thus, it will be understood that many additional changes in the details, materials, steps and arrangement of parts, which have been herein described and illustrated in order to explain the nature of the invention, may be made by those skilled in the art within the principle and scope of the invention as expressed in the appended claims.

What is claimed is:

1. An unmanned, autonomous, undersea platform launched from a host vessel, the platform extending a sphere of influence of the vessel, the platform comprising:

at least one communication system maintaining communications between the platform and the host vessel;

a hydrodynamically and stealth shaped outer surface, the shaped outer surface minimizing noise, wake and detectability of the platform;

a mast extendibly attached to the platform and forming a vertical stabilizer of the platform when the mast is extended from the platform, the mast supporting the at least one communication system above a surface of the undersea environment when the mast is extended for communications, the at least one communication system forming a horizontal stabilizer for the platform when the mast is extended, the horizontal stabilizer conforming to the shaped outer surface when the mast is not extended;

at least one sensor gathering data of an undersea environment surrounding the platform; and at least one onboard data processor controlling autonomous operation of the platform based on a combination of mission directives input to the processor and environmental data received from the at least one sensor.

2. The platform of claim 1 wherein the outer surface further includes movable vanes controlled by the processor for maneuvering the platform within the undersea environment, the vanes conforming to the shaped outer surface and not protruding substantially therefrom.

3. The platform of claim 1 wherein the platform further comprises at least one directional thruster port controlled by the processor for propelling the platform through the undersea environment, the ports conforming to the shaped outer surface and not protruding substantially therefrom.

4. The platform of claim 1 wherein the at least one communication system further comprises a planar phased array antenna for satellite communications, the planar phased array antenna conforming to the shaped surface of the platform sensor.

5. The platform of claim 1 wherein the at least one communications system comprises electronic warfare antennas structurally embedded in the outer surface of the platform.

6. The platform of claim 1 wherein the at least one sensor comprises conformal active and passive acoustic arrays.

7. The platform of claim 1 wherein the at least one sensor comprises at least one of a wake detection sensor, an environmental sensor, a chemical sensor, an optical sensor and a navigational sensor.

8. The platform of claim 1 wherein the at least one data processor comprises a neural network based processor.

9. The platform of claim 1 wherein the host vessel is a submarine, the platform being configured to swim out from the submarine when launched.

10. The platform of claim 1 wherein the host vessel is a surface ship, the platform being configured to swim down from the surface ship when launched into the undersea environment.

11. The platform of claim 1 wherein the host vessel is an airborne vessel, the platform being configured to be air dropped from the airborne vessel into the undersea environment when launched.

12. The platform of claim 1 further comprising at least one of a defensive weapons system and an offensive weapons system, the weapons systems being controlled by the onboard data processor in response to the gathered sensor data.

13. The platform of claim 12 wherein the defensive weapons system further comprises at least one of a short range defensive weapons system and a long range defensive weapons system.

14. The platform of claim 13 wherein the short range weapons system comprises a deployable underwater gun, the gun conforming to the shaped outer hull when not deployed.

15. The platform of claim 13 wherein the long range weapons system comprises attack countermeasures.

16. The platform of claim 12 wherein the offensive weapons system comprises at least one of a stealth torpedo, a covert launch torpedo and a high speed torpedo.

17. The platform of claim 12 wherein the at least one sensor and the at least one of a defensive and an offensive weapons system are integrated into the host vessel and controlled by the host vessel when the platform is attached to the host vessel.

18. An unmanned, automous undersea platform launched from a host vessel, the platform comprising:

a hydrodynamically and stealth shaped outer surface, the shaped outer surface minimizing noise, wake and detectability of the platform;

at least one planar phased array antenna system for satellite communications between the platform and the host vessel, the planar phased array antenna conforming to the shaped surface of the platform;

a mast extendibly attached to the platform and forming a vertical stabilizer of the platform when the mast is extended from the platform, the mast supporting the planar phased array above a surface of the undersea environment when the mast is extended for satellite communications, the planar phased array forming a horizontal stabilizer for the platform when the mast is extended;

at least one sensor gathering data of an undersea environment surrounding the platform; and at least one onboard data processor controlling autonomous operation of the platform based on a combination of mission directives input to the processor and environmental data received from the at least one sensor.

19. The platform of claim 18 further comprising at least one of a defensive weapons system and an offensive weapons system, the weapons systems being controlled by the onboard data processor in response to the gathered sensor data when the platform is remote from the host vessel, the weapons systems being capable of control by the host vessel when the platform is attached to the host vessel.

* * * * *